US006756169B2

(12) United States Patent
Lin et al.

(10) Patent No.: US 6,756,169 B2
(45) Date of Patent: Jun. 29, 2004

(54) IMAGING MEMBERS

(75) Inventors: Liang-Bih Lin, Webster, NY (US); Cindy C. Chen, Rochester, NY (US); James M. Duff, Mississauga (CA); Timothy P. Bender, Port Credit (CA); Harold F. Hammond, Webster, NY (US); James M. Markovics, Rochester, NY (US); Linda L. Ferrarese, Rochester, NY (US); John S. Chambers, Rochester, NY (US); Anna M. Main, Rochester, NY (US)

(73) Assignee: Xerox Corporation, Stanford, CT (US)

( * ) Notice: Subject to any disclaimer, the term of this patent is extended or adjusted under 35 U.S.C. 154(b) by 34 days.

(21) Appl. No.: 10/202,296

(22) Filed: Jul. 23, 2002

(65) Prior Publication Data

US 2004/0018440 A1 Jan. 29, 2004

(51) Int. Cl.[7] ..... G03G 5/04

(52) U.S. Cl. ..... 430/78; 430/56; 430/75; 430/73; 430/72

(58) Field of Search ..... 430/75, 96, 72, 430/73, 56, 78

(56) References Cited

U.S. PATENT DOCUMENTS 4,265,990 A 5/1981 Stolka et al. ..... 430/59
4,784,928 A * 11/1988 Kan et al. ..... 430/58
5,336,577 A 8/1994 Spiewak et al. ..... 430/59
5,473,064 A * 12/1995 Mayo et al. ..... 540/141
5,851,712 A * 12/1998 Muto et al. ..... 430/83
6,586,148 B1 * 7/2003 Graham et al. ..... 430/58.65

OTHER PUBLICATIONS

Borsenberger, Paul M. Organic Photoreceptors for Imaging Systems. New York: Marcel–Dekker, Inc. (1993) pp. 190–195 & 349–355.*

* cited by examiner

*Primary Examiner*—Christopher Rodee
(74) *Attorney, Agent, or Firm*—Fay, Sharpe, Fagan, Minnich & McKee, LLP

(57) ABSTRACT

A member including for example, a supporting layer and a single photogenerating layer, the photogenerating layer comprising particles including hydroxygallium phthalocyanine phthalocyanine Type V, x polymorph metal free phthalocyanine, or chlorogallium phthalocyanine dispersed in a matrix comprising an arylamine hole transporter and an electron transporter selected from the group consisting of N,N'bis(1,2-dimethylpropyl)-1,4,5,8-naphthalenetetracarboxylic diimide, 1,1'-dioxo-2-(4-methylphenyl)-6-phenyl-4-(dicyanomethylidene)thiopyran, and a quinone selected from the group consisting of carboxybenzylhaphthaquinone, and tetra (t-butyl) diphenoquinone, and mixtures thereof, and a film forming binder.

27 Claims, No Drawings

IMAGING MEMBERS

CROSS REFERENCE TO COPENDING APPLICATION

U.S. patent application Ser. No. 09/302524, filed in the names of D. Murti et al on Apr. 30, 1999, discloses a photoconductive imaging member which is comprised of a supporting substrate, and thereover a layer comprised of a photogenerator hydroxygallium component, a charge transport component, and an electron transport component. U.S. patent application Ser. No. 09/627,283, filed in the names of Lin, et al, on Jul. 28, 2000 , discloses an imaging member having a single electrophotographic photoconductive insulting layer. The entire disclosures of each of these Patent Applications is incorporated herein by reference.

BACKGROUND

This invention relates in general to electrophotographic imaging members and, more specifically, to electrophotographic imaging members having a low surface energy and a single photogenerating layer dispersed with submicron size polytetrafluroethylene, and to processes for forming images on the member.

A low surface energy single layer photoreceptor refers for example, to a device wherein a photoelectroactive pigment, hole transport and electron transport materials, polytetrafluroethylene particles and a polymeric binder are dissolved or dispersed within a single layer. In embodiments, a typical low surface energy single layer device is composed of from about 1 to about 3 percent of a photoelectroactive pigment of a polymer, from about 1 to about 20 percent of a polytetrafluroethylene particle, from about 40 to about 60 percent of bisphenol-Z polycarbonate, from about 25 to about 40 percent of a hole transport molecule, and from about 10 to about 25 percent of an electron transport molecule. Single layer devices are fabricated with dispersions containing all the functional materials in a solvent mixture of tetrahydrofuran, toluene, or a mixture of tetrahydrofuran and monochlorobenzene.

A number of current electrophotographic imaging members are multi-layered imaging members comprising a substrate and a plurality of other layers such as a charge generating layer and a charge transport layer. These multilayered imaging members also often contain a charge blocking layer and an adhesive layer between the substrate and the charge generating layer.

One problem encountered with multilayered photoreceptors comprising a charge generating layer and the charge transport layer is that the thickness of the charge transport layer, which is normally the outermost layer, tends to become thinner during image cycling. This change in thickness causes changes in the electrical properties of the photoreceptor. Thus, in order to maintain image quality, complex and sophisticated electronic equipment is necessary in the imaging machine to compensate for the electrical changes. This increases the complexity of the machine, cost of the machine, size of the footprint occupied by the machine, and the like. Without proper compensation of the changing electrical properties of the photoreceptor during cycling, the quality of the images formed degrades due to spreading of the charge pattern on the surface of the imaging member and a decline in image resolution. High quality images are essential for digital copiers, duplicators, printers, and facsimile machines, particularly laser exposure machines that demand high resolution images.

To achieve long-life in conventional multi-layer photoreceptors, several advanced concepts such as protective overcoat and wear resistant fillers in the charge transport layer (charge transport layer) have been pursued.

Alternatively, owing to their top-photogeneration mechanism, a long operating life is also feasible using single layer organic photoreceptors, with thicknesses of, for example, in the range of from about 25 micrometers to about 40 micrometers. Another method of extending photoreceptor life is by using a thick one layer device, typically based on organic materials. Single layer organic photoreceptors have many advantages over multi-layer photoreceptors in manufacturing costs, total cost of ownership environmental friendliness, and print quality. The photogeneration mechanism is at the top or near-the-top of the photoreceptor surface, and therefore the photoreceptor is less prone to problems or variants associated with substrate-related and thickness-dependent photoelectrical properties. Top photogeneration also allows thick devices to be implemented as dictated by constraints of photoinduced discharge properties. One aspect of this invention is to provide submicrometer size polytetrafluroethylene particles in single layer organic photoreceptors to, for example, lower the surface energy of the resulting devices and to improve toner cleaning and transfer efficiency. In embodiments, the particles may also enhance light scattering efficiency and further alleviate the need for substrate treatments.

However, similar to conventional charge transport layer, single layer organic photoreceptors containing only photoelectroactive pigments, transport molecules, and for example, nominal polymeric binder may not be toner compatible, especially for toners generated by emulsion aggregation processes because they are susceptible to low toner transfer efficiency and cleaning failures. Proposals to disperse submicrometer size polytetrafluroethylene (polytetrafluroethylene) particles in single layer organic photoreceptors to lower the surface energy of the devices and therefore to improve print quality and print life have been advanced. Long-life photoreceptors compatible with chemical toners are of value to high speed, high image quality color machines.

Photoreceptors with small polytetrafluroethylene and silicate particles and doped charge transport layers are believed to be emulsion aggregate toner compatible and have up to two times better wear life in imaging systems employing a bias charge roller charging unit and a polyurethane based cleaning blade than a conventional charge transport layer. Nylon-based overcoats, containing charge transport molecules with optional inorganic pigment additives, have also shown some wear resistant properties.

Attempts have been made to fabricate electrophotographic imaging members comprising a substrate and a single photogenerating layer in place of a plurality of layers. However, in formulating single photogenerating layer photoreceptors, many problems must be overcome including charge acceptance for hole and/or electron transporters from photoelectroactive pigments. In addition to electrical compatibility and performance, the formulation for forming a single layer photoreceptor must have the proper rheology and resistance to agglomeration to enable acceptable coatings. Also, compatibility among pigment, hole transport, and electron transport molecules, and film forming binder is important. As employed herein, the expression "single photogenerating layer" is defined as a single electrophotographically active layer capable of retaining an electrostatic charge in the dark during electrostatic charging, imagewise exposure and image development.

REFERENCES

U.S. Pat. No. 4,265,990 to Stolka et al, issued May 5, 1981 illustrates a photosensitive member having at least two electrically operative layers is disclosed. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional imaging mode which usually includes charging, exposure to light, and development.

U.S. Pat. No. 5,336,577 to Spiewak et al, issued Aug. 9, 1994, discloses a thick organic ambipolar layer on a photoresponsive device simultaneously capable of charge generation and charge transport. In particular, the organic photoresponsive layer contains an electron transport material such as a fluorenylidene malonitrile derivative and a hole transport material such as a dihydroxy tetraphenyl benzadine containing polymer. These may be complexed to provide photoresponsivity, and/or a photoresponsive pigment or dye may also be included.

The entire disclosures of these patents are incorporated herein by reference.

BRIEF SUMMARY

Aspects of the present invention relate to mixing optimal single layer formulations comprising a first and second photosensitivity pigment to achieve a wide range of photoinduced discharge characteristics (PIDC) properties. In embodiments of this invention, optimized single layer formulations based on type V hydroxygallium phthalocyanine (HOGaPC) or X polymorph metal free phthalocyanine (x-H2PC) are used to obtain differing photosensitivities and PIDC shapes.

Disclosed is an electrophotographic imaging member containing particles comprising a first sensitivity pigment and a low sensitivity pigment dispersed in a matrix comprising an arylamine hole transport molecule, an electron transport molecule, and a film forming binder. Also disclosed is an improved electrophotographic imaging member which provides much needed flexibility in obtaining a wide range of photoinduced discharge characteristics (PIDC) in single layer photoreceptors. Further disclosed is an improved electrophotographic imaging member comprising a single photogenerating layer which can be fabricated with fewer coating steps at reduced cost, a single photogenerating layer which eliminates charge spreading, therefore, enabling higher resolution. Also disclosed is an improved electrophotographic imaging member which has improved cycling and stability characteristics and a single photogenerating layer for which photoinduced discharge characteristics (PIDC) curves do not change with time or repeated use. Further disclosed is an improved electrophotographic imaging member comprising a single photogenerating layer which is ambipolar and can be operated at either positive or negative biases, and which is low surface energy and emulsion aggregate toner compatible.

Aspects illustrated herein relate to a substrate and a single photogenerating layer, the photogenerating layer comprising particles comprising a first sensitivity pigment and a second sensitivity pigment dispersed within a matrix comprising:

an arylamine hole transporter, an electron transporter and a film forming binder.

The imaging member may be imaged by depositing a uniform electrostatic charge on the imaging member, exposing the imaging member to activating radiation in image configuration to form an electrostatic latent image, and developing the latent image with electrostatically attractable marking particles to form a toner image in conformance to the latent image.

Any suitable substrate may be employed in the imaging member of this invention. The substrate may be opaque or substantially transparent, and may comprise any suitable material having the requisite mechanical properties. Thus, for example, the substrate may comprise a layer of insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium and the like, or exclusively be made up of a conductive material such as aluminum, chromium, nickel, brass and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer.

The thickness of the substrate depends on many factors, including economical considerations, thus this layer may be of substantial thickness, for example over 3,000 micrometers, or of a minimum thickness. In one embodiment, the thickness of this layer is from about 75 micrometers to about 300 micrometers.

If desired, an optional adhesive layer may be formed on the substrate. Typical materials employed in an undercoat layer include, for example, polyesters, polyamides, poly (vinyl butyral), poly(vinyl alcohol), polyurethane and polyacrylonitrile, and the like. Typical polyesters include, for example, VITEL® PE100 and PE200 available from Goodyear Chemicals, and MOR-ESTER 49,000® available from Norton International. The undercoat layer may have any suitable thickness, for example, of from about 0.001 micrometers to about 30 micrometers. A thickness of from about 0.1 micrometers to about 3 micrometers is used in a specific embodiment. Optionally, the undercoat layer may contain suitable amounts of additives, for example, of from about 1 weight percent to about 10 weight percent, of conductive or nonconductive particles, such as zinc oxide, titanium dioxide, silicon nitride, carbon black, and the like, to enhance, for example, electrical and optical properties. The undercoat layer can be coated onto a supporting substrate from a suitable solvent. Typical solvents include, for example, tetrahydrofuran, dichloromethane, xylene, ethanol, methyl ethyl ketone, and mixtures thereof.

In embodiments, the single photogenerating layer utilized in the electrophotographic imaging member is a single electrophotographically active layer capable of retaining an electrostatic charge in the dark during electrostatic charging, imagewise exposure and image development. Thus, this single photogenerating layer photoreceptor is unlike a multilayered photoreceptor which has at least two electrophotographically active layers including at least one charge generating layer and at least one separate charge transport layer. In other words, the single photogenerating layer imaging member of this invention is free of any charge generating layer between the supporting layer and the single photogenerating layer. Moreover, the single photogenerating layer imaging member of this invention may also be free of any charge blocking layer or any anti-plywood layer between the supporting layer and the single photogenerating layer.

The components of the single photogenerating layer comprise photogenerating particles for example, of Type V hydroxygallium phthalocyanine, x-polymorph metal free phthalocyanine, or chlorogallium phthalocyanine photogenerating pigments dispersed in a matrix comprising an arylamine hole transport molecules and certain selected electron transport molecules. Type V hydroxygallium phthalocyanine is well known and has X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. The photogenerating pigment primarily functions to absorb the incident radiation and generates electrons and holes. In a negatively charged member, holes are transported to the photoconductive surface to neutralize negative charge and electrons are transported to the substrate to permit photodischarge. In a positively charged member, electrons are transported to the surface where they neutralize the positive charges and holes are transported to the substrate to enable photodischarge. By selecting the appropriate amounts of charge and electron transport molecules, ambipolar transport can be obtained, that is, the imaging member can be charged negatively or positively, and the member can also be photodischarged. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media. Removing any ionic species formed by washing with water. Concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles preferably have an average particle size of less than about 5 micrometers.

Any suitable charge transport molecule such as an arylamine hole transporter molecules may be utilized in the single photogenerating layer. In embodiments an arylamine charge hole transporter molecule may be represented by:

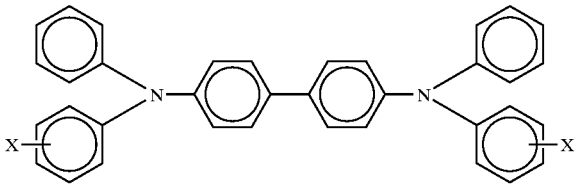

wherein X is selected from the group consisting of alkyl and halogen. Typically, the halogen is a chloride. The alkyl typically contains from 1 to about 10 carbon atoms, and in embodiments from 1 to about 5 carbon atoms. Typical aryl amines include, for example, N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine where the halo substituent is preferably a chloro substituent. Other specific examples of aryl amines include, 9-9-bis(2-cyanoethyl)-2,7-bis(phenyl-m-tolylamino)fluorene, tritolylamine, N,N'-bis(3,4 dimethylphenyl)-N"(1-biphenyl) amine, 2-bis((4'-methylphenyl) amino-p-phenyl) 1,1-diphenyl ethylene, 1-bisphenyl-diphenylamino-1-propene, and the like.

An electron transporter selected for example, from the group consisting of, a carboxlfluorenone malonitrile (CFM) represented by:

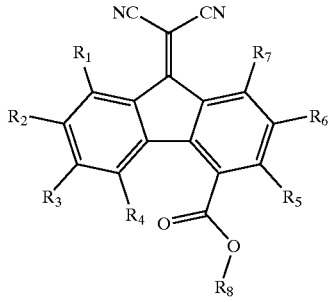

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, or a nitrated fluoreneone represented by:

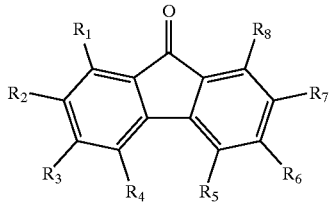

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, and at least 2 R groups are chosen to be nitro groups.

Or a N,N'bis(dialkyl)-1,4,5,8-naphthalenetetracarboxylic diimide derivative or N,N'bis(diaryl)-1,4,5,8-naphthalenetetracarboxylic diimide derivative represented by:

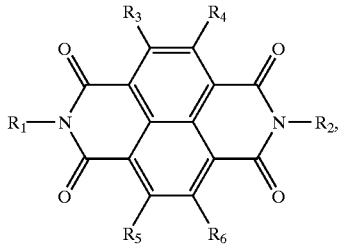

wherein R1 is substituted or unsubstituted alkyl, branched alkyl, cycloalkyl, alkoxy or aryl, such as phenyl, naphthyl, or a higher polycyclic aromatic such as anthracene R2 is alkyl, branched alkyl, cycloalkyl, or aryl, such as phenyl, naphthyl, or a higher polycyclic aromatic such as anthracene or the same as R1; R1 and R2 can be chosen independently to have total carbon number of from about 1 to about 50 and in embodiments from about 1 to about 12. R3, R4, R5 and R6 are alkyl, branched alkyl, cycloalkyl, alkoxy or aryl, such as phenyl, naphthyl, or a higher polycyclic aromatic such as anthracene or halogen and the like. R3, R4, R5 and R6 can be the same or different. In the case were R3, R4, R5 and R6 are carbon, they can be chosen independently to have a total carbon number of from about 1 to about 50 and in embodiments from about 1 to about 12.

Or a 1,1'-dioxo-2-(aryl)-6-phenyl-4-(dicyanomethylidene)thiopyran derivative represented by:

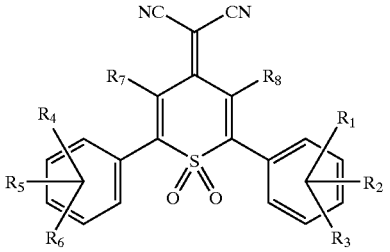

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, or a carboxybenzylnaphthaquinone represented by:

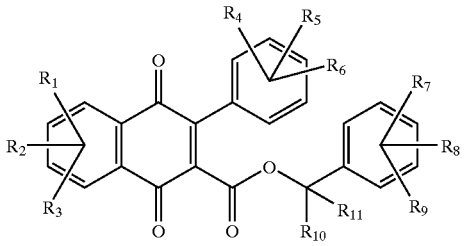

and/or

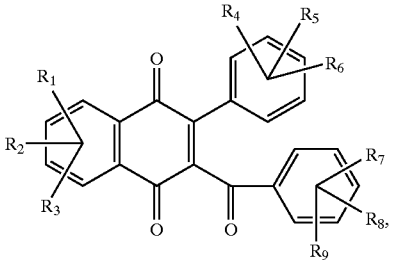

wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, or a diphenoquinone represented by:

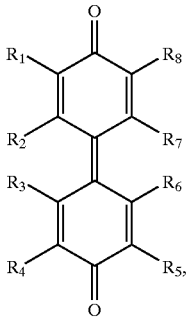

and mixtures thereof, wherein each R is independently selected from the group consisting of hydrogen, alkyl having 1 to 40 carbon atoms, alkoxy having 1 to 40 carbon atoms, phenyl, substituted phenyl, higher aromatic such as naphthalene and antracene, alkylphenyl having 6 to 40 carbons, alkoxyphenyl having 6 to 40 carbons, aryl having 6 to 30 carbons, substituted aryl having 6 to 30 carbons and halogen, and a film forming binder.

These electron transporting materials contribute to the ambipolar properties of the final photoreceptor and also provide the desired rheology and freedom from agglomeration during the preparation and application of the coating dispersion. Moreover, these electron transporting materials ensure substantial discharge of the photoreceptor during image wise exposure to form the electrostatic latent image.

Any suitable film forming binder may be utilized in the photoconductive insulating layer of this invention. Typical film forming binders include, for example, polyesters, polyvinyl butyrals, polycarbonates, polystyrene-b-polyvinyl pyridine, poly(vinyl butyral), poly(vinyl carbazole), poly (vinyl chloride), polyacrylates, polymethacrylates, copolymers of vinyl chloride and vinyl acetate, phenoxy resins, polyurethanes, poly(vinyl alcohol), polyacrylonitrile, polystyrene, and the like. Specific electrically inactive binders include polycarbonate resins with a weight average molecular weight of from about 20,000 to about 100,000. In embodiments, a $M_w$ of from about 50,000 to about 100,000 is specifically selected. More specifically, good results are achieved with poly(4,4'-diphenyl-1,1'-cyclohexane carbonate) PCZ, Bisphenol-Z polycarbonate; poly(4,4'-diphenyl-1,1'-cyclohexane carbonate-500, with a weight average molecular weight of 51,000; poly(4,4'-diphenyl-1,1'-cyclohexane carbonate-400, with a weight average molecular weight of 40,000.

The photogenerating pigments can be present in various amounts, such as, for example, from about 0.05 weight percent to about 30 weight percent and in embodiments, from about 0.1 weight percent to about 10 weight percent, based on the total weight of the photoconductive insulating layer after drying. Charge transporter components, such as arylamine hole transporter molecules can be present in various effective amounts, such as, in an amount of from about 5 weight percent to about 50 weight percent and in embodiments, in an amount of from about 20 weight percent to about 40 weight percent. The electron transporter molecule can be present in various amounts, such as in an amount of from about 1 weight percent to about 40 weight percent and in embodiments, from about 5 weight percent to about 30 weight percent, based on the total combined weight of the hole transport molecules and the electron transport molecules. In embodiments, the combined weight of the arylamine hole transport molecules and the electron transport molecules in the photogenerating layer is from about 35 percent to about 65 percent by weight, based on the total weight of the photogenerating layer after drying. The low surface energy and low friction enabling polytetrafluroethylene particles can be presented in an amount of about 0.1 weight percent to about 40 weight percent. The GF-300 surfactant can be presented in an amount of 0.001 weight percent to about 2 weight percent. The film forming polymer binder can be present in an amount of from about 10 weight percent to about 75 weight percent and in embodiments, from about 30 weight percent to about 60 weight percent, based on the total weight of the photogenerating layer after drying. The hole transport and electron transport molecules are dissolved or molecularly dispersed in the film forming binder. The expression "molecularly dispersed", as employed herein is defined as dispersed on a molecular scale.

The above materials can be processed into a dispersion useful for coating by any of the conventional methods used to prepare such materials. These methods include ball milling, media milling in both vertical or horizontal bead mills, paint shaking the materials with suitable grinding media, and the like to achieve a suitable dispersion. The photoconductive insulating layer may be prepared by any suitable method such as, for example, from a dispersion. A typical dispersion is prepared by using the following procedure:

(1) Dispersing the polytetrafluroethylene particles, GF300 surfactant, and the binder by roll milling the materials with glass beads in a mixed solvent of tetrahydrofuran, (2) Roll milling the photogenerating pigment and the binder material in a 1:1 weight ratio and from about 10 to about 11 percent solids in tetrahydrofuran along with several hundred grams of 3 mm diameter stainless steel balls (or yttrium fortified zirconium) for from about 2 to about 12 hours, (3) Weighing the poly(4,4'-diphenyl-1,1'-cyclohexane carbonate (polycarbonate-Z) and hole and electron transport molecules in tetrahydrofuran and toluene to a 7:3 solvent to weight ratio, (4) adding the mill base and polytetrafluroethylene dispersion to the desirable ratio, and (5) rolling, to mix the materials (without milling beads).

The photogenerating pigment particles, electron transport molecules, and charge transport molecules coating mixture can be coated by any suitable technique, for example, by using a spray coater, dip coater, extrusion coater, roller coater, wire-bar coater, slot coater, doctor blade coater, gravure coater, and the like. Any suitable solvent may be utilized for coating. Typical solvents include, for example, ketones, alcohols, aromatic hydrocarbons, halogenated aliphatic hydrocarbons, ethers, amines, amides, esters, and the like. Specific examples of solvents include cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like. Since the photoresponsive imaging members of the present invention can be prepared by a number of known coating methods, the coating process parameters are dependent on the specific process, materials, coating component proportions, the final coating thickness desired, and the like. Drying may be carried out by any suitable technique. Typically, drying is carried out a temperature of from about 40 degrees centigrade to about 200 degrees centigrade for a suitable period of time. Typical drying times include, for example, from about 5 minutes to about 10 hours under still or flowing air conditions.

The thickness of the single layer after dying can typically be, for example, from about 3 micrometers to about 50 micrometers and in embodiments, from about 5 micrometers to about 40 micrometers. The maximum thickness of the photoconductive insulating layer in any given embodiment is dependent primarily upon factors such as photosensitivity, electrical properties, and mechanical considerations.

The imaging member may by employed in any suitable process such as, for example, copying, duplicating, printing, faxing, and the like. Typically, an imaging process may comprise forming a uniform charge on the imaging member of the present invention. Exposing the imaging member to activating radiation in image configuration to form an electrostatic latent image. Developing the latent image with electrostatically attractable marking material to form a marking material image, and transferring the marking material image to a suitable substrate. If desired, the transferred marking material image may be fixed to the substrate or transferred to a second substrate. Electrostatically attractable marking materials are well known and comprise, for example, thermoplastic resin, colorant, such as pigment, charge additive, and surface additives. Typical marking materials are disclosed in U.S. Pat. Nos. 4,560,635; 4,298,697 and 4,338,390, the entire disclosures thereof being incorporated herein by reference. Activating radiation may be from any suitable device such as an incandescent light, image bar, laser, and the like. The polarity of the electrostatic latent image on the imaging member of the present invention may be positive or negative. The hydroxygallium, x-polymorph metal free phthalocyanine, and chlorogallium phthalocyanine photogenerating pigments primarily function to absorb the incident radiation and generate electrons and holes. In a negatively charged imaging member, holes are transported to the imaging surface to neutralize negative charge and electrons are transported to the substrate to permit photodischarge. In a positively charged imaging member, electrons are transported to the imaging surface where they neutralize the positive charges and holes are transported to the substrate to enable photodischarge. By selecting the appropriate amounts of hole and electron transport molecules, ambipolar transport can be achieved, that is, the imaging member can be uniformly charged negatively or positively and the member can thereafter be photodischarged.

EMBODIMENTS

Several drum devices of physical thicknesses of from about 16 to about 28 micrometers were fabricated using dip coating techniques. The devices were photoelectrically tested along with surface contact angle measurements. Table 1 shows key electrical results and water contact angles of several single layer devices based on Type V hydroxygallium phthalocyanine, x-polymorph metal free phthalocyanine, and chlorogallium phthalocyanine, with and without polytetrafluroethylene particles. The water contact angles for devices doped with polytetrafluroethylene particles are significantly lower than that of devices without polytetrafluroethylene particles, suggesting that the surface energies are lowered for the former devices.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosures herein.

TABLE 1

Comparison of single layer organic photoreceptors varying ratios of from about 100% HoGaPC to zero % H2PC, to zero% HoGaPC to 100% H2PC

| Formulation | HoGaPC:x-$H_2$PC (First) (Second) | dV/dX (+v; 600 V\|24 $\mu$m) | V (2.6 ergs) | $V_{ER}$ | Dark Decay (ΔV in 26 ms) | $V_{depletion}$ |
|---|---|---|---|---|---|---|
| 1 | 80:20 | 305 | 130 | 52 | 78 | 89 |
| 2 | 70:30 | 303 | 142 | 48 | 68 | 82 |
| 3 | 60:40 | 290 | 140 | 50 | 63 | 84 |
| 4 | 50:50 | 265 | 152 | 56 | 62 | 78 |
| 5 | 40:60 | 252 | 162 | 61 | 60 | 89 |
| 6 | 30:70 | 240 | 180 | 60 | 48 | 67 |
| 7 | 20:80 | 220 | 195 | 58 | 51 | 75 |
| 8 | 10:90 | 185 | 203 | 62 | 42 | 73 |
| 9 | 5:90 | 174 | 210 | 64 | 35 | 56 |
| Control 1 | 100:0 | 315 | 133 | 51 | 78 | 84 |
| Control 2 | 0:100 | 175 | 208 | 72 | 24 | 50 |

EXAMPLE 1

A pigment dispersion was prepared by roll milling 2.6 grams of first pigment, Type V hydroxygallium phthalocyanine pigment particles and 2.6 grams of, poly(4,4'-diphenyl-1,1'-cyclohexane carbonate-400 binder, available from Mitsubishi Gas Chemical Co., Inc. binder in 34.8 grams of tetrahydrofuran with four hundred grams of three millimeter diameter steel balls for from about 24 to about 72 hours.

Separately, 9.94 grams of poly(4,4'-diphenyl-1,1'-cyclohexane carbonate) was added together with 6.48 grams of N,N'-diphenyl-N,N'-bis(methylphenyl)-1,1-biphenyl-4,4'-diamine, 4.32 of N,N'bis(1,2-dimethylpropyl)-1,4,5,8-naphthalenetetracarboxylic diimide, 40.94 grams of terahydrofuran and 11.68 grams monochlorobenzene. This mixture was rolled in a glass bottle until the solids were dissolved, then 6.65 grams of the above pigment dispersion was added to form a dispersion containing Type V hydroxygallium phthalocyanine, poly(4,4'-diphenyl-1,1'-cyclohexane carbonate), N,N'-diphenyl-N,N'-bis(methylphenyl)-1,1-biphenyl-4,4'-diamine, and N,N'bis(1,2-dimethylpropyl)-1,4,5,8-naphthalenetetracarboxylic diimide in a solids weight ratio of (2:48:30:20) and a total solid contents of 27 percent; and rolled to mix (without milling beads). Various dispersions were prepared at total solids contents ranging from 25 percent to 28.5 percent. More than 5 dispersions were prepared at these ratios. These dispersions were applied by dip coating to aluminum drums having a length of from about 24 to about 36 centimeters and a diameter of 30 millimeters. For the 27 weight percent dispersion, a pull rate of 100, 120, 140, and 160 mm/min provided 20, 24, 30, and 36 micrometer thick single photoconductive insulating layers on the drums after drying. Thickness of the resulting dried layers were determined by capacitive measurement and by transmission electron microscopy.

With the above imaging members it is believed that there can be generated images of excellent resolution with minimal or no background deposits, and which members are reusable for extended time periods. Although the invention has been described with reference to specific preferred embodiments, it is not intended to be limited thereto, rather those having ordinary skill in the art will recognize that variations and modifications including equivalents, substantial equivalents, similar equivalents, and the like may be made therein which are within the spirit of the invention and within the scope of the claims.

What is claimed is:

1. A member comprising:

a supporting layer and a single photogenerating layer comprising particles comprising a first photo sensitivity pigment and a second photo sensitivity pigment dispersed in a matrix comprising a hole transport molecule, an electron transport molecule, and a film forming wherein the single photogenerating layer further comprises polytetrafluoroethylene particles having a diameter of from about 15 micrometers to about 40 micrometers.

2. A member according to claim 1 wherein the photogenerating layer comprises from about 0.1 percent to about 10 percent by weight of each of the first and second photosensitivity pigments, based on the total weight of the photogenerating layer.

3. A member according to claim 1 wherein the member is free of a charge blocking layer between the supporting layer and the photogenerating layer.

4. A member according to claim 1 wherein the photogenerating layer has a thickness from about 3 micrometers to about 50 micrometers after drying.

5. A member according to claim 1 wherein the first photosensitivity pigment is selected from the group consisting of Type V hydroxygallium phthalocyanine and X polymorph metal free phthalocyanine.

6. A member according to claim 1 wherein the photogenerating layer has a thickness of from about 10 micrometers to about 30 micrometers after drying.

7. A member according to claim 1 wherein the photogenerating layer has a thickness of from about 20 micrometers to about 25 micrometers after drying.

8. A member according to claim 1 wherein the first photosensitivity pigment is Type V hydroxygallium phthalocyanine.

9. A member according to claim 1 wherein the second photosensitivity pigment is x polymorph metal free phthalocyanine.

10. A member according to claim 1 wherein the ratio of the first photosensitivity pigment to the second photosensitivity pigment is from about 0.01 to about 100.

11. A member according to claim 1 wherein the diameter of the polytetrafluroethylene particle is from about 20 to about 30 micrometers in diameter.

12. A member according to claim 1 wherein the photogenerating pigments are selected from the group consisting of Type V hydroxygallium phthalocyanine, x-polymorph metal free phthalocyanine, and chlorogallium phthalocyanine.

13. A member according to claim 1 wherein the pigments are a mixture of hydroxygallium phthalocyanine and x-polymorph metal free phthalocyanine.

14. A member in accordance with claim 1 wherein said photogenerating layer absorbs light of a wavelength of from about 370 to about 950 nanometers.

15. A member according to claim 1 wherein the film forming binder is selected from the group consisting of polyesters, polyvinyl butyrals, polycarbonates, polystyrene-b-polyvinyl pyridine, poly(vinyl butyral), poly(vinyl carbazole), poly(vinyl chloride), polyacrylates, polymethacrylates, copolymers of vinyl chloride and vinyl acetate, phenoxy resins, polyurethanes, poly(vinyl alcohol), polyacrylonitrile, and polystyrene.

16. A member according to claim 1 wherein the film forming binder is a polycarbonate.

17. A member according to claim 1 wherein the photogenerating layer comprises from about 10 percent to about 75 percent by weight of the film forming binder, based on the total weight of the photogenerating layer after drying.

18. A member according to claim 1 wherein the photogenerating layer comprises from about 0.05 percent to about 30 percent by weight of Type V hydroxygallium phthalocyanine, based on the total weight of the photogenerating layer after drying.

19. A member according to claim 1 wherein the photogenerating layer comprises from about 0.1 percent to about 10 percent by weight of Type V hydroxygallium phthalocyanine, based on the total weight of the photogenerating layer after drying.

20. A member according to claim 1 wherein the hole transport molecule is an aryl amine represented by:

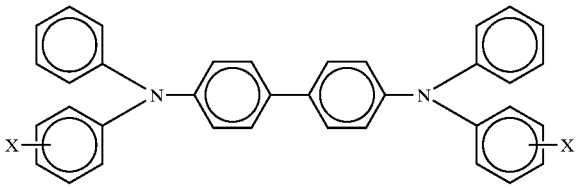

wherein X is selected from the group consisting of alkyl and halogen.

21. A member according to claim 20 wherein the generating layer comprises from about 1 percent to about 40 percent by weight of the electron transporter, based on the combined weight of the arylamine hole transport molecules and the electron transport molecules in the photogenerating layer.

22. A member according to claim 20 wherein the combined weight of the arylamine hole transport molecules and the electron transport molecules in the photogenerating layer is from about 20 percent to about 80 percent by weight, based on the total weight of the electrophotographic photoconductive insulating photogenerating layer after drying.

23. A member according to claim 1 wherein the hole transport molecule is selected from the group consisting of N,N'-diphenyl-N,N'-bis(3-methylphenyl)-[1,1'-biphenyl]-4,4'diamine; N,N'-diphenyl-N,N'-bis(alkylphenyl)-1,1-biphenyl-4,4'-diamine; Tritolylamine; N,N'-bis-(3,4-dimethylphenyl)-4-biphenyl amine; N,N',bis-(4-methylphenyl)-N,N'-bis(4-ethylphenyl)-1,1'-3,3'-dimethylbiphenyl)-4,4'-diamine; phenanthrene diamine; arylamine; enamine; and stilbene molecules.

24. A member according to claim 23 wherein the arylamine is N,N'-diphenyl-N,N'-bis(3-methylphenyl)-[1,1'-biphenyl]-4,4'-diamine.

25. A member according to claim 1 wherein the photogenerating layer comprises from about 5 percent to about 50 percent by weight of the hole transport molecule, based on the combined weight of the hole transport molecules and the electron transport molecule in the photogenerating layer.

26. A member according to claim 1 wherein the electron transport molecule is selected from the group consisting of: 1,1'-dioxo-2-(4-methylphenyl)-6-phenyl-4-(dicayanomethylidene)thiopyran; Butoxy carbonyl fluorenylidene malononitrile; Carboxybenzylnaphthaquinone; and Tetra (t-butyl) diphenoquinone.

27. A member according to claim 1 wherein the electron transport molecule is a carboxylfluorenone malonitrile (CFM) represented by:

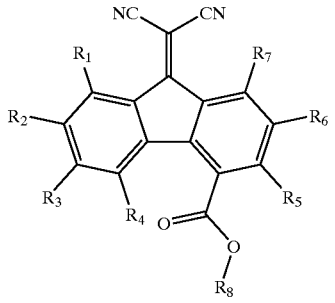

wherein each R is independently selected from the group consisting of hydrogen, alkyl, alkoxy, phenyl, substituted phenyl, and halogen, or a nitrated fluoreneone represented by:

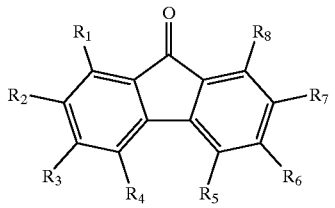

wherein each R is independently selected from the group consisting of hydrogen, nitro, alkyl, alkoxy, phenyl, aryl, and halogen, and wherein at least 2 R groups are chosen to be nitro groups, or a N,N'bis(dialkyl)-1,4,5,8-naphthalenetetracarboxylic diamide or N,N'bis(diaryl)-1,4,5,8-naphthalenetetracarboxylic diamide represented by:

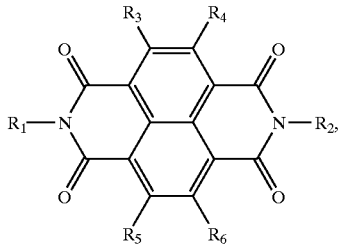

wherein R1 is substituted or unsubstituted alkyl, or aryl, R2 is alkyl, or aryl, such as phenyl; R1 and R2 can be chosen independently to have total carbon number of from about 1 to about 50; R3, R4, R5 and R6 are alkyl, alkoxy, aryl, or halogen and R3, R4, R5 and R6 can be the same or different; wherein if R3, R4, R5 and R6 are carbon-containing they are chosen independently to have a total carbon number of from about 1 to about 50, or a 1,1'-dioxo-2-(aryl)-6-phenyl-4-(dicyanomethylidene) thiopyran represented by:

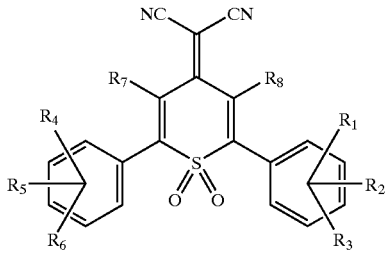

wherein each R is independently selected from the group consisting of hydrogen, alkyl, alkoxy, phenyl, aryl, and halogen, or a naphthoquinone represented by:

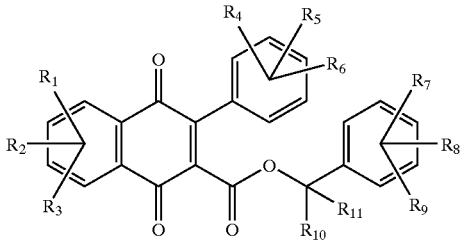

and/or

-continued

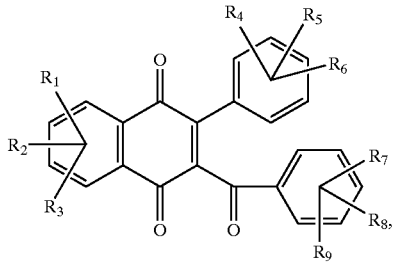

wherein each R is independently selected from the group consisting of hydrogen, alkyl, alkoxy, phenyl, aryl, and halogen, or a diphenoquinone represented by:

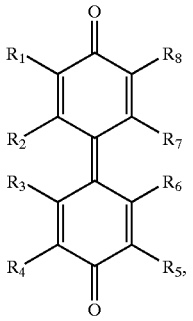

and mixtures thereof, wherein each R is independently selected from the group consisting of hydrogen, alkyl, alkoxy, phenyl, or aryl.

* * * * *